US011352917B2

(12) United States Patent
Mueller et al.

(10) Patent No.: US 11,352,917 B2
(45) Date of Patent: Jun. 7, 2022

(54) APPARATUS FOR CAMSHAFT TIMING ADJUSTMENT WITH BUILT IN PUMP

(71) Applicant: HELLA GmbH & CO. KGAA, Lippstadt (DE)

(72) Inventors: Hagen Mueller, Bad Wuennenberg (DE); Theodor Hueser, Geseke (DE)

(73) Assignee: Hella GmbH & Co. KGaA, Lippstadt (DE)

( * ) Notice: Subject to any disclaimer, the term of this patent is extended or adjusted under 35 U.S.C. 154(b) by 23 days.

(21) Appl. No.: 16/785,318

(22) Filed: Feb. 7, 2020

(65) Prior Publication Data

US 2020/0173315 A1 Jun. 4, 2020

Related U.S. Application Data

(63) Continuation of application No. PCT/EP2017/069942, filed on Aug. 7, 2017.

(51) Int. Cl.
*F01L 1/344* (2006.01)

(52) U.S. Cl.
CPC ... *F01L 1/3442* (2013.01); *F01L 2001/34433* (2013.01); *F01L 2303/00* (2020.05)

(58) Field of Classification Search
CPC ..... F01L 1/344; F01L 1/3442; F01L 2001/34433; F01L 2001/34426; F01L 2001/3443; F01L 2001/34423; F01L 2303/00; F04C 2/077; F04C 2/04; F04C 2/063; F16H 39/36
USPC ..... 123/90.15, 90.17
See application file for complete search history.

(56) References Cited

U.S. PATENT DOCUMENTS 5,107,804 A * 4/1992 Becker ..... F01L 1/34409 123/90.17
5,386,807 A 2/1995 Linder
5,450,825 A * 9/1995 Geyer ..... F01L 1/3442 123/90.17
5,497,738 A 3/1996 Siemon et al.
7,182,053 B2 * 2/2007 Meintschel ..... F01L 1/34 123/90.15

(Continued)

FOREIGN PATENT DOCUMENTS

DE 10 2009 037 260 A1 2/2011
DE 102009037260 A1 * 2/2011 ..... F01L 1/3442
EP 1 544 418 A1 6/2005

*Primary Examiner* — Devon C Kramer
*Assistant Examiner* — Kelsey L Stanek
(74) *Attorney, Agent, or Firm* — Muncy, Geissler, Olds & Lowe, P.C.

(57) ABSTRACT

An apparatus for camshaft timing adjustment, having a drive disc and a hub rotationally supported relative to each other and defining a common rotational axis wherein the hub is arranged within the drive disc or vice versa, a vane being accommodated in an adjusting chamber defined by the drive disc and the hub and separating the adjusting chamber into a first sub-chamber and a second sub-chamber, wherein the vane is attached to the hub or the drive disc, a hydraulic pump having a high pressure pump chamber, a low pressure pump chamber and a pump for pumping a hydraulic fluid from the low pressure pump chamber to the high pressure pump chamber, each pump chamber being fluidly connected to the first sub-chamber and the second sub-chamber.

27 Claims, 8 Drawing Sheets

(56) References Cited

U.S. PATENT DOCUMENTS

| | | | | |
|---|---|---|---|---|
| 2009/0120388 | A1* | 5/2009 | Lee | F01L 1/352<br>123/90.11 |
| 2009/0173298 | A1* | 7/2009 | Hayashi | F01L 1/3442<br>123/90.17 |
| 2013/0134338 | A1* | 5/2013 | Suzuki | F01L 1/3442<br>251/129.15 |

* cited by examiner

APPARATUS FOR CAMSHAFT TIMING ADJUSTMENT WITH BUILT IN PUMP

This nonprovisional application is a continuation of International Application No. PCT/EP2017/069942, which was filed on Aug. 7, 2017, and which is herein incorporated by reference.

BACKGROUND OF THE INVENTION

Field of the Invention

The present invention relates to an apparatus for camshaft timing adjustment. The apparatus comprises a drive disc and a hub rotationally supported relative to each other and defining a common rotational axis wherein the hub is arranged within the drive disc or vice versa. The apparatus further comprises a vane being accommodated in an adjusting chamber defined by the drive disc and the hub. The vane separates the adjusting chamber into a first sub-chamber and a second sub-chamber. The vane is attached to the hub or to the drive disc. The apparatus comprises a hydraulic pump having a high pressure pump chamber, a low pressure pump chamber and a pump for pumping a hydraulic fluid from the low pressure pump chamber to the high pressure pump chamber. Each pump chamber is fluidly connected to the first sub-chamber and the second sub-chamber and can be put in fluid communication with the respective sub-chamber by a valve assembly. The valve assembly has a valve actuator. The valve assembly has a first state for enabling a flow of the hydraulic fluid from the second sub-chamber to the first sub-chamber. The valve assembly has a second state for enabling a flow of the hydraulic fluid from the first sub-chamber to the second sub-chamber. Furthermore, the invention relates to a method for manufacturing an apparatus for adjusting camshaft timing.

Description of the Background Art

In the art, different configurations of apparatuses for camshaft timing adjustment are known. Apparatuses for camshaft timing adjustment, which can as well be referred to as a camshaft timing apparatuses, are widely used for adjusting dynamically the opening and closing times of intake and outtake valves of a combustion engine during its operation.

Most combustion engines comprise a crankshaft for transforming a translational movement of cylinder pistons into a rotational movement and a camshaft for operating intake and outtake valves of the respective cylinders. The camshaft defines the opening and closing times of the valves relative to each other and is typically driven by the crankshaft via a transmission, mostly by means of a gear drive, a belt drive, a chain drive or the like. For instance, a drive disc like a sprocket or a pulley may be coupled to the camshaft and engaged with a corresponding gear of the crankshaft such, that by driving the drive disc, the camshaft rotates according to the crankshaft. In four stroke engines (i.e. Otto-type engines) the camshaft is usually driven to rotate with half the speed of the crankshaft.

Accordingly, apparatuses for camshaft timing adjusting have to allow for dynamically adjusting the angular relation between the rotational position of the camshaft and the rotational position of the crankshaft during operation of the combustion engine. For example the angular relation may be adjusted depending on a throttle position and/or the rotational speed of the crankshaft which is usually measured in RPM (Rotations Per Minute). As the angular relationship defines the point of time for opening and closing of each valve relative to a particular position of an associated cylinder piston, changing the angular relation between the crankshaft and the camshaft is also referred to as 'timing'.

A possibility to allow for adjusting the timing of the camshaft relative to the crankshaft during operation of the combustion engine is to use an apparatus for camshaft timing adjusting comprising a drive disc being configured to be coupled to the crankshaft and a hub being arranged within the drive disc or vice versa. The drive disc and the hub define a common rotational axis and rotationally support each other for a relative rotation about the common rotational axis. The hub may be torque-proof coupled to the camshaft. Thus, by adjusting the angular relation of the hub relative to the drive disc, the angular relation between the camshaft and the crankshaft and, correspondingly, the timing of the valves may be adjusted.

To enable an adjustment of the angular relation between the hub and the drive disc it has been suggested to provide an apparatus for camshaft timing adjustment with one or more adjusting chambers defined by the drive disc and the hub as well as one or more vanes. The vanes are accommodated in the adjusting chambers and separate them each into a first sub-chamber and a second sub-chamber. A chamber should be understood herein as a cavity or hollow space which is enclosed by inner surfaces of a body, e.g. by casing walls or the like.

By pumping a working fluid, for instance a hydraulic oil, from the first sub-chambers to the second sub-chambers, the vanes may be angularly displaced within and relative to the adjusting chambers, which results in an angular adjustment of the hub relative to the drive disc. Vanes and adjustment chambers, thus, can be considered as a hydraulic drive of the apparatus for camshaft timing adjustment.

Pumping of the working fluid between the first and second sub-chambers is usually achieved by means of a hydraulic pump. The hydraulic pump is fluidly connected to the first and second sub-chambers of the apparatus for camshaft timing adjustment and configured to pump the working fluid between the first and second sub-chambers, thereby swivelling the hub relative to the drive disc. Only to avoid any misunderstanding, swivelling indicates a rotation of the hub and the drive disc relative to each other about the common rotational axis. The term is used to indicate that the rotation is limited to a certain angle of relative rotation. The limitation is due to constructional details of the particular apparatus, e.g. the dimensions of the adjustment chambers and the vanes.

The hydraulic pump may have a high pressure pump chamber, a low pressure pump chamber and a pump for pumping the working fluid from the low pressure pump chamber to the high pressure pump chamber. Each pump chamber of the hydraulic pump is fluidly connected to the first sub-chambers and the second sub-chambers. The hydraulic pump is typically disposed separate from the camshaft and driven by the crankshaft which reduces the available engine capacity.

To allow for selectively pumping the working fluid back and forth between the first sub-chambers and the second sub-chambers the apparatus for camshaft timing adjustment is provided with a valve assembly having a valve actuator for controlling a fluid flow between the pump chambers and the sub-chambers. The valve actuator may be mechanically coupled to a valve control unit.

The valve assembly has a first state in which the high pressure pump chamber is fluidly connected to the first sub-chambers and the low pressure pump chamber is fluidly connected to the second sub-chambers. When the valve assembly is in the first state the angular relation between the drive disc and the hub changes into a first direction. The valve assembly has a second state in which the high pressure pump chamber is fluidly connected to the second sub-chambers and the low pressure pump chamber is fluidly connected to the first sub-chambers. When the valve assembly is in the second state the angular relation between the drive disc and the hub changes into a second direction which is opposite to the first direction. As a result, the valve assembly selectively allows for swivelling forth and swivelling back of the hub relative to the disc drive.

Exemplary apparatuses for camshaft timing adjustment of this type are disclosed e.g. in U.S. Pat. No. 8,291,876 B1 and U.S. Pat. No. 6,453,859 B1.

SUMMARY OF THE INVENTION

It is therefore an object of the present invention to provide a compact, reliable and light weight apparatus for camshaft timing adjustment which can be manufactured at reduced cost and on the other hand provides for fast adjustments of the crankshaft timing.

The object is solved by an apparatus for camshaft timing adjustment of the type set forth initially wherein the valve assembly is arranged within the hydraulic pump and the hydraulic pump is arranged within the hub.

The apparatus for camshaft timing adjustment comprises a drive disc and a hub defining a common rotational axis. The drive disc and the hub rotationally support each other allowing for a rotating movement of the hub relative to the drive disc about the common rotational axis. For example, the hub may support the drive disc via an axial bearing, e.g. a plain bearing enabling the two to swivel relative to each other. Accordingly, the hub may have first bearing surface sections and the drive disc may have complementary second bearing surface sections providing axial and radial bearing when abutting on each other. Other types of bearings may be used as well.

The hub can be at least partly arranged within the drive disc and, for instance, may be supported by the drive disc via axial and radial bearings enabling the hub to swivel relative to the drive disc.

The drive disc may be connected or configured to be connected to a crankshaft of a combustion engine by a transmission, e.g. by a belt drive, a gear drive, a chain drive or the like. The hub is torque-proof coupled to the camshaft of the combustion engine. A rotation of the hub thus drives the camshaft. Alternatively, the hub can be torque-proof coupled to the crankshaft, while the drive disc may be connected to the camshaft by a transmission. For sake of simplicity and without restricting the invention to the following preferred configuration, it is assumed herein that (i) the hub is torque-proof coupled to or configured to be torque-proof coupled to the camshaft, and that (ii) the disc drive is configured to be driven by the crankshaft via transmission.

The apparatus further comprises one or more adjusting chambers being defined by the drive disc and/or the hub and one or more vanes each being accommodated in an adjusting chamber and separating the associated adjusting chamber into a first sub-chamber and a second sub-chamber. In other words, each vane inhibits a free (i.e. uncontrolled) flow of the hydraulic fluid between the first and second sub-chambers of the associated adjusting chamber. Thereto, the vane is preferably in touch with the axial boundaries of the associated adjusting chamber and with one of the radially outer boundary and the radially inner boundary of the associated adjusting chamber. Thus, by providing a fluid flow from the first sub-chamber into the second sub-chamber, the vane can be swivelled relative to the associated adjusting chamber.

The vanes are attached to the drive disc or to the hub. Again, for sake of simplicity and without any restriction, it is assumed herein, that the vanes are attached to the hub. Attachment means here that swivelling of the vanes in the adjusting chambers causes a swivelling of the hub relative to the drive disc.

The apparatus further comprises a hydraulic pump being arranged at least partially within the hub and/or the drive disc and having a high pressure pump chamber and a low pressure pump chamber. To avoid any misunderstanding, pump chamber means any internal cavity of the hydraulic pump which is fluidly connected with a port of the hydraulic pump. For example, a pump chamber can just be a portion of a fluid connection between a high pressure port and a low pressure port of the hydraulic pump. The hydraulic pump comprises a pump for pumping a hydraulic fluid from the low pressure pump chamber to the high pressure pump chamber. Each pump chamber is fluidly connected to each first sub-chamber and each second sub-chamber. With this configuration, the hydraulic fluid may be pumped from the first sub-chambers into the second sub-chambers or vice versa, depending of the state of a valve assembly for controlling fluid communication of the sub-chambers with the pump chambers. Herein, the terms "fluid communication" and "fluid connection" are used interchangeably for a path between two points which can be passed by a fluid.

Preferably, the apparatus further comprises a valve assembly. The valve assembly is arranged within the hub and/or the drive disc and comprises a valve actuator. The valve assembly has a first state. In this first state the high pressure pump chamber is put in fluid communication to the first sub-chamber as well as the low pressure pump chamber to the second sub-chamber, respectively. In the first state, the valve actuator may be in a first position, which may be referred to as a forward position, providing a fluid communication between the high pressure pump chamber and the first sub-chamber as well as between the low pressure pump chamber and the second sub-chamber. The valve assembly has a second state. In this second state the high pressure pump chamber is put in fluid communication to the second sub-chamber as well as the low pressure pump chamber to the first sub-chamber, respectively. In the second state, the valve actuator may be in a second position, which may be referred to as a backward position, providing a fluid communication between the high pressure pump chamber and the second sub-chamber as well as between the low pressure pump chamber and the first sub-chamber. By selecting one of the first and second positions of the valve actuator, the hydraulic fluid alternately (i) is pumped from the second sub-chamber to the first sub-chamber to swivel the hub relative to the drive disc in a forward direction or (ii) is pumped from the first sub-chamber to the second sub-chamber to swivel the hub relative to the drive disc in a backward direction.

The valve actuator may preferably be axially movable and thus the first position is a first axial position, the second position is a second axial position and if present any further position is a further axial position.

The invention, hence, is based on the idea that integrating the valve assembly into the hydraulic pump and, at the same time, integrating the hydraulic pump into the hub leads to a very compact camshaft timing apparatus. Apart from that, the hydraulic pump can immediately be driven by the camshaft without imposing any immediate load on the crankshaft.

The drive disc preferably has a casing accommodating the hub. The casing comprises a casing wall and a casing lid axially closing the casing. For example, the casing may have a cylindrical casing wall which is centered with respect to the common rotational axis and axially protrudes from a base disc of the drive disc. The casing may be axially closed by a circular casing lid which is secured to the casing wall on the axially opposite side of the casing wall with respect to the base disc. Thus, the hub accommodated therein may be supported axially and radially. On the one hand, outer axial surface sections of the hub may abut on corresponding inner axial surface sections of the base disc and the casing lid, respectively, forming an axial bearing. On the other hand, outer peripheral surface sections of the hub may abut on inner peripheral surface sections of the casing wall forming a radial bearing. The base disc may have a peripheral external gear for engaging with a corresponding toothed drive belt or, alternatively, a drive chain and/or a cog wheel, all of which may be used to couple the apparatus to the crankshaft of the combustion engine.

The drive disc may comprise a plurality of separator. The separator may be configured as and/or comprise protrusions extending radially inward from the casing wall and providing at least one, preferably two or more adjusting chambers from each other in a circumferential direction. In case of more than one adjusting chamber the separator may separate neighbored adjustment chambers from each other. Preferably, the apparatus may comprise a plurality of vanes each extending radially outward from the hub into an associated adjusting chamber. The separator may thus have side faces providing circumferential boundaries of the adjusting chambers. If the separator are provided by protrusions being attached to or integrally formed with the drive disc, the apparatus can be kept very compact and thus small. Further precision is enhanced as well as assembly simplified. The protrusions do not necessarily have straight side faces. The side faces can be curved and/or inclined against the radial direction, but the radially extending protrusions should provide a radially extending barrier between two adjusting chambers being formed by or attached to the drive disk. The separator in some sense can be considered as spokes but they do not need to bear any radial load. In this picture, however, the side faces of two neighbored spokes would face each other. In between of the side faces of two neighbored protrusions there is an adjusting chamber.

A plurality of separator and a plurality of vanes as well allows for avoiding any dynamic imbalance of the drive disc and the hub, respectively. Of course, the separator may alternatively protrude radially outward from the hub, if the vanes extend radially inward from the casing wall in turn.

Exactly two vanes and two adjusting chambers preferably form pairs being preferably disposed on opposite sides of the common rotational axis, respectively. This is the simplest configuration of vanes and adjusting chambers without any dynamic imbalance of the drive disc and the hub, respectively. Such apparatuses for camshaft timing adjustment are particularly easy and economic in manufacture. More generally dynamic imbalance can be minimized if the n vanes and chambers are rotationally symmetric in a sense that any rotation around integer multiples of 360°/n ($n \geq 2$) maps the vanes and the adjustment chamber onto themselves.

The first sub-chambers and the second sub-chambers may alternate in a circumferential direction. An alternating sequence of first and second sub-chambers provides a symmetric structure of the required fluid connections to the first and second sub-chambers.

In a preferred embodiment the hub defines a central through-hole accommodating the hydraulic pump. The central through-hole may be cylindrical for ease of manufacture. Additionally, arranging the hydraulic pump within the hub is very easy with a central through-hole defined in the hub.

The hub may comprise a first hub lid and a second hub lid axially closing the through-hole on opposite sides of the hub. The second hub lid preferably comprises a coupling configured to provide a torque-proof connection with a camshaft wherein the coupling and/or the camshaft may extend through a central camshaft through-hole of the drive disc. The first and second hub lids may have multiple functions. On the one hand, they provide inner surface sections for forming an axial bearing with complementary surface sections of the hydraulic pump. On the other hand, they may axially close the high pressure pump chambers and the low pressure pump chambers of the hydraulic pump. Apart from that, the second hub lid allows for the camshaft of the combustion engine to be coupled to the hub. Thus, the first and second hub lids preferably are axially and rotationally secured to the hub.

The hub may comprise at least one, preferably two or more first adjusting channels each fluidly connecting a first sub-chamber with a first port or the valve assembly. The two first adjusting channels may be configured as grooves in a first axial surface of the hub each extending radially outward from a central through-hole of the first hub lid to a vane and each bending into a first peripheral direction to open into a first sub-chamber. The hub may further comprise at least one, preferably two or more second adjusting channels each fluidly connecting a first sub-chamber with a second port or the valve assembly. The two second adjusting channels may be configured as grooves in a second axial surface of the hub each extending radially outward from a central through-hole of the second hub lid to a vane and each bending into a second peripheral direction to open into a second sub-chamber wherein the first and second adjusting channels have straight sections formed in the first and second hub lids, respectively. In other words, the first and second sub-chambers of the apparatus for camshaft timing adjustment may be fluidly connected to the hydraulic pump via a central through-hole in the first and second hub lids and via the first and second adjusting channels configured in the first and second hub lids as well as in the axial surfaces of the vanes, respectively. This configuration of the fluid connection between the hydraulic pump within the hub and the first and second sub-chambers defined by the drive disc and the hub is very easy to manufacture and also reliable during operation.

The hydraulic pump may have a stator and a rotor, the pump being supported by the stator or the rotor and configured for pumping the hydraulic fluid from the low pressure pump chamber to the high pressure pump chamber due to a rotation of the rotor relative to the stator. This configuration of a hydraulic pump is very simple and allows for small dimensions of the hydraulic pump in order to fit in the central through-hole of the hub.

The stator may be integral with and/or torque-proof connected to the hub. Alternatively of additionally, the pump may be supported by the rotor. Of course, the pump may alternatively be supported by the stator. It has to be emphasized, that the terms 'rotor' and 'stator' only indicate a relative rotation of these two components of the hydraulic pump. Therefore, the rotor might be integral with or torque-proof connected to the hub instead.

The stator comprises an internal gear being attached to the hub and the rotor may comprise a rotor body being disposed within the internal gear. Preferably, the rotor body is supported rotationally about the common rotational axis e.g. such that teeth of the internal gear and peripheral surface sections of the rotor body abut to form a radial bearing. The internal gear of the hydraulic pump may either be integral with the hub or torque-proof secured to the hub, i.e. by a form fit, a tight fit, any permanent connection or even a combination of these. Preferably the tips of the teeth are configured to provide small peripheral surface sections which are complementary to the peripheral surface sections of the rotor body.

The pump is a gear wheel being supported by the rotor body and/or engaged with the internal gear and having a rotational axis parallel to the common rotational axis. The gear wheel preferably has an at least essentially circular cylindrical envelope. This means that the tips of the teeth of the gear wheel define a circular cylindrical surface being centered on the rotational axis of the gear wheel. The gear wheel has a rotational axis being at least essentially parallel with the common rotational axis (maximum inclination angle ±30°, preferably ±20°, even more preferred ±10° or even better ±2.5°). This eases manufacturing and enhances the life cycle of the apparatus. When the rotor body rotates relative to the internal gear, the gear wheel rotates relative to the rotor due to their engaging teeth. Thereby, the gear wheel and the rotor are counter-rotating, i.e. the gear wheel rotates in the counterclockwise direction when the rotor body rotates in the clockwise direction or vice versa.

In other words, the hydraulic pump is preferably an internal gear pump. However, different pump types as, for example, a vane cell pump or different pump designs may alternatively be used as long as they, at the same time, can be accommodated within the hub or the drive disc, can accommodate a valve assembly and can be fluidly connected to the first and second sub-chambers.

The rotor body may comprise two separating arms and two pumping arms extending in a radial direction and alternating in a circumferential direction and separating from each other two high pressure pump chambers and two low pressure pump chambers. The high pressure pump chambers and low pressure pump chambers alternate in a circumferential direction. The two pumping arms may each support a bearing pin rotationally supporting a gear wheel and defining a fluid passage between a high pressure pump chamber and an adjacent low pressure pump chamber. The two gear wheels preferably have at least essentially parallel rotational axes. This optimizes the fluid flow between the low pressure pump chambers and high pressure pump chambers and eases manufacturing of the apparatus. Again, at least essentially parallel means that a deviation from parallelism is smaller than or equal to ±30° (preferably ±20°, even more preferred ±10° or even better ±2.5°). Additionally, the rotational axes of the gear wheels are at least essentially parallel to the common rotational axis (maximum inclination angle of ±30°, preferably ±20°, even more preferred ±10° or even better ±2.5°). As well the rotational axes of the gear wheels are preferably evenly spaced to the common rotational axis (relative distance deviation preferably within ±20%, even more within ±10% or even better within ±2.5%). Both measures simplify manufacture and increase lifetime as constructional imbalances of the apparatus are reduced.

The rotor body can comprise two first internal valve chambers each being fluidly connected to each high pressure pump chamber by a high pressure channel. The rotor body may further comprise two second internal valve chambers each being fluidly connected to each low pressure pump chambers by a low pressure channel wherein the first and second internal valve chambers are juxtaposed in an axial direction. The pressure of the hydraulic fluid in the internal valve chambers, thus, is preferably identical to the connected high pressure pump chambers or low pressure pump chambers, respectively. Accordingly, the first and second internal valve chambers can be considered as internal high and low pressure ports of the hydraulic pump, respectively. Each of the high pressure channels and low pressure channels may simply be configured as a through-hole extending from the respective internal first or second valve chamber to the respective high or low pressure pump chamber.

The internal valve chambers may be arranged in a first pair and a second pair each comprising a first internal valve chamber and a second internal valve chamber being separated by a separation wall, wherein the first and second pairs are juxtaposed in an axial direction and wherein the axial sequence of the first and second internal valve chambers is different between the pairs. This pairwise configuration of the first and second internal valve chambers corresponds to the configuration of the first and second adjusting channels of the hub.

The rotor body may comprise a first annular channel and a second annular channel each surrounding the corresponding first or second pair of internal valve chambers. Each annular channel may further have two axial channel sections being disposed spaced apart in the separating arms, and preferably two radial channel sections. The radial channel sections connect corresponding axial ends of the axial channel sections wherein each outer axial channel section may be configured as a groove extending in the corresponding axial surface of the rotor body. The first and second annular channels may be, via the central through-holes of the first and second hub lids, in a permanent fluid connection with the first and second adjusting channels and, indirectly, with the first and second sub-chambers, respectively.

The rotor body may have a central actuating through-hole extending axially through the rotor body and being fluidly connected with the first internal valve chambers, the second internal valve chambers and the radial channel sections of the first and second annular channels. In other words, the rotor body has a double function. On the one hand, the rotor body allows for pumping the hydraulic fluid from the low pressure pump chamber to the high pressure pump chamber of the hydraulic pump. On the other hand, the rotor body is part of the valve assembly providing fluid connections to the high pressure pump chambers and to the low pressure pump chambers of the hydraulic pump and to the first and second sub-chambers in the form of the first and second pairs and the first and second annular channels, respectively. The actuating through-hole may preferably have a cylindrical shape thus defining a first and a second port of the valve assembly at its axially opposite ends and.

The valve actuator may comprise a pin-like valve needle having an operating section and an actuating section wherein the actuating section is arranged central and axially displaceable in the actuating through-hole of the rotor body and wherein the operating section extends through the central through-hole of the first hub lid and a central torque transmitting through-hole of the casing lid and has a head at its outer free end. The valve actuator may be axially coupled to a valve control unit via the head. Thereby, the head may provide axial and radial bearing surface sections for allowing the valve actuator to rotate at a different angular speed than an interface of the valve control unit providing complementary surface sections. The actuating section is configured to open and close the first and second internal valve chambers as well as the angular channels at different axial positions of the valve actuator.

The actuating section may comprise a plurality of annular protrusions being juxtaposed in an axial direction and defining axial clearances in between. The annular protrusions may be arranged and configured to selectively and exclusively open fluid connections between the first and second internal valve chambers and the first and second annular channels. In a first axial position of the valve actuator fluid connections between the first internal valve chambers and the first annular channel as well as the second internal valve chambers and the second annular channel are opened, respectively. In a second position of the valve actuator fluid connections between the first internal valve chambers and the second annular channel as well as the second internal valve chambers and the first annular channel are opened, respectively. The axial length and the radial width of the protrusions as well as the axial length of the clearances correspond to the axial configuration of the first and second pairs with the first and second internal valve chambers therein, of the first and second annular channels and the axial distances between these elements.

The valve assembly may have a third state fluidly connecting the high pressure pump chamber to the low pressure pump chamber and fluidly separating the first sub-chamber from the second sub-chamber. Correspondingly, the valve actuator in a third axial position may open a connection between the first internal valve chambers and the second internal valve chambers while closing the first and second annular channels. The third axial position of the valve actuator, which may be referred to as a neutral position, provides a short circuit fluid connection between the high pressure pump chambers and the low pressure pump chambers and separates the first sub-chambers from the second sub-chambers. When the valve assembly is in the third state the angular relation between the drive disc and the hub does not change. In other words, by selecting the third position of the valve actuator the hydraulic fluid is not pumped between the first and second sub-chambers to not swivel the hub relative to the drive disc.

The apparatus may comprise a torque transmission being torque-proof connected to the rotor for establishing a relative rotation between the rotor and the stator. Thus, by securing the torque transmission to a static part, i.e. a non-rotating part of the combustion engine, the hydraulic pump is exclusively and immediately driven by a rotation of the hub or the drive disc relative to the torque transmission. The torque transmission is preferably configured as a bolt, e.g. as cylindrical bolt.

The torque transmission preferably extends through the torque transmission through-hole of the casing lid and the central through-hole of the first hub lid, wherein the torque transmission has a coupler disposed at an outer end and a connector disposed at an opposite inner end, the connector being configured to establish the torque-proof connection between the torque transmission and the rotor body. The coupler may be configured as a hexagonal head. Alternatively, any other suitable structure may be provided as long as it allows for rotationally securing the torque transmission to a static part.

The torque transmission may define a central operating through-hole extending axially which is penetrated by the operating section of the valve actuator. This central operating through-hole preferably has a cylindrical shape with a diameter which, at the same time, rotationally supports the operating section of the valve actuator and seals the casing of the drive disc against loss of the hydraulic fluid.

The connector may be configured as a pin-like protrusion being disposed eccentrically and extending axially from the inner free end, and the rotor body may comprise a complementary recess formed in an axial surface and being engaged by the connector. This is a very simple measure to provide a torque-proof coupling between two parts which abut axially and rotate about a common rotational axis.

The connector may be configured as a plurality of protrusions being disposed around the operating through-hole, particularly two protrusions disposed on opposite sides of the operating through-hole, and that the rotor body comprises corresponding recesses. Providing more than a single protrusion allows for applying the torque more symmetrically. Of course, any different connector may be used as well.

Furthermore, the invention provides a method for manufacturing an apparatus for camshaft timing adjustment with a drive disc, a hub, a hydraulic pump and a valve assembly, particularly an inventive apparatus, comprising the steps: arranging the hydraulic pump within the hub; and arranging the valve assembly within the hydraulic pump.

This manufacturing method is based on the idea, to create a very compact and self-contained camshaft timing apparatus. By integrating the hydraulic pump into the apparatus no additional external pump is required for operating the apparatus. By integrating the valve assembly into the hydraulic pump no additional external valve assembly is required for operating the apparatus. In other words, manufacturing methods for creating a self-contained hydraulic pump and/or for creating a self-contained valve assembly are not needed any longer which leads to an essential reduction of time and costs required for manufacturing a camshaft timing apparatus.

The apparatus and the method of the invention can as well be used for other applications, i.e. not only for camshaft timing, but e.g. for anti-roll bar adjustment. The apparatus enables to adjust the preload of a torsion bar and, thus, of an anti-roll bar. More generally speaking the apparatus can be considered as a drive enabling an angular adjustment of two pieces being rotatably supported, i.e. being rotatable relative to each other around the common rotational axis. Thus more generally speaking the term 'hub' as used above and in the claims can be replaced by the term 'first piece' and the term 'drive disc' can be replaced by 'second piece being rotatable relative to the first piece'. Operation of the apparatus enables to swivel the first and second pieces relative to each other quickly even if high torques are required for this swivelling.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION

Figure 1:
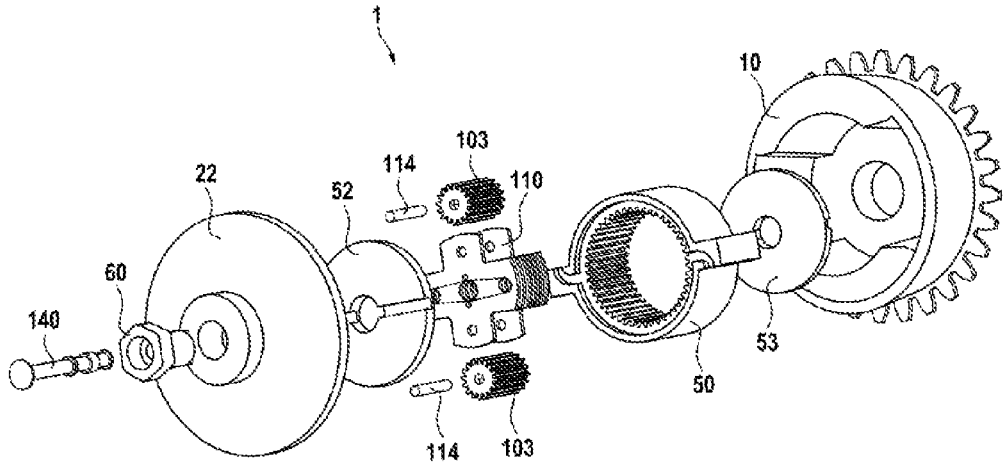
FIG. 1 shows an exploded perspective view of a camshaft timing apparatus according to an embodiment of the present invention.

FIG. 1 shows an exploded view of the components of an apparatus for camshaft timing adjustment according to an embodiment of the invention, as well referred to as camshaft timing apparatus 1. The apparatus 1 comprises a drive disc 10 and a hub 50. The drive disc 10 is configured to be connected to a crankshaft of a combustion engine. The hub 50 is configured to be torque-proof coupled to a camshaft of the combustion engine. The drive disc 10 and the hub 50 define a common rotational axis 2 and are rotationally supported relative to each other allowing for a rotating, i.e. for a swivelling movement of the hub 50 relative to the drive disc 10 about the common rotational axis 2. Correspondingly, an angular relation between the crankshaft and the camshaft of the combustion engine can be adjusted by swivelling the hub 50 relative to the drive disc 10.

Figure 2:
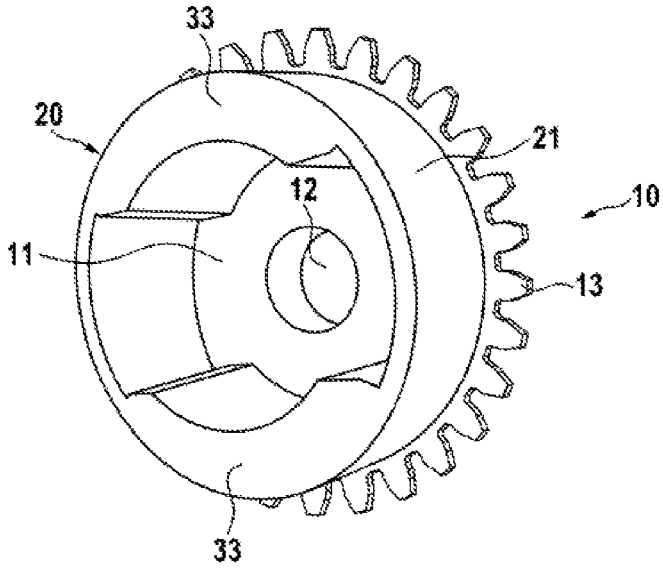
FIG. 2 shows a perspective view of the drive disc of the camshaft timing apparatus according to the embodiment shown in FIG. 1.
Figure 3:
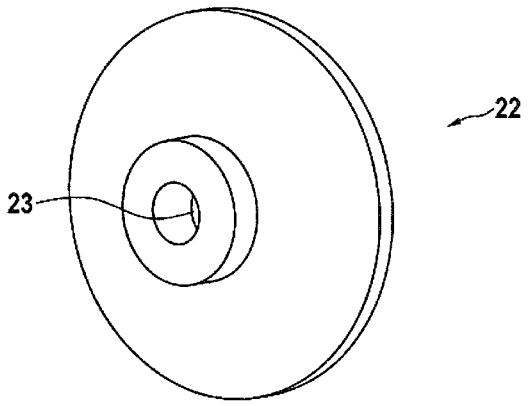
FIG. 3 shows a perspective view of the casing lid of the camshaft timing apparatus according to the embodiment shown in FIG. 1.

As can be seen best from FIGS. 2 and 3, the drive disc 10 has a circular base disc 11, a cylindrical casing wall 21 and a circular casing lid 22 which form a casing 20. The base disc 11 has a plurality of teeth 13 forming a peripheral external gear for engaging with a corresponding toothed drive belt or, alternatively, a drive chain and/or a cog wheel, all of which may be used to couple the apparatus 1 to the crankshaft of the combustion engine.

The casing wall 21 is integral with the base disc 11, centered with respect to the common rotational axis 2 and axially protrudes from the base disc 11. The casing lid 22 is secured to the casing wall 21 axially opposite to the base disc 11 and closes the casing 20 axially.

The hub 50 is arranged within the drive disc 10 and accommodated in the casing 20. The drive disc 20 and the hub 50 are rotationally supported relative to each other axially and radially via axial and radial bearings enabling the hub 50 to swivel relative to the drive disc 10. On the one hand, outer axial surface sections of the hub 50 abut on corresponding inner axial surface sections both of the base disc 11 and the casing lid 22 forming axial bearings, respectively. On the other hand, outer peripheral surface sections 58 of the hub 50 abut on inner peripheral surface sections of the casing wall 21 forming a radial bearing.

Figure 4:
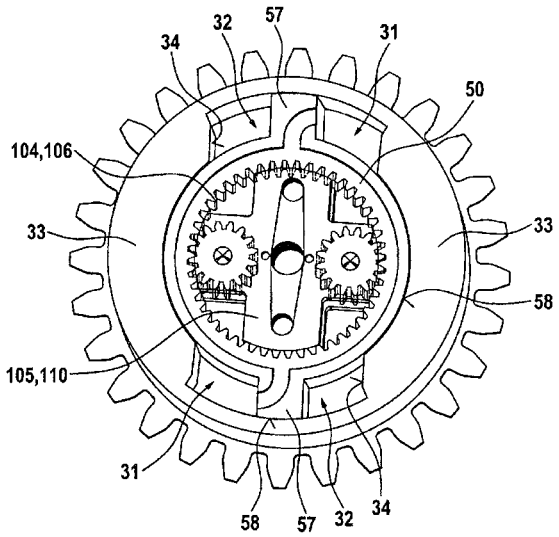
FIG. 4 shows an axial front view of the partially assembled camshaft timing apparatus according to the embodiment shown in FIG. 1.

The apparatus 1 further comprises two adjusting chambers 30 being defined by the drive disc 10 and the hub 50, as can be best seen from FIG. 4. The drive disc 10 comprises a plurality of separator 33 being protrusions being formed by the drive disk 10. The separator 33 extend radially inward from the casing wall 21 and provide a radially extending barrier between the two adjusting chambers 30 and separating the two adjusting chambers 30 from each other in a circumferential direction. The separator 33 have straight side surfaces 34 providing circumferential boundaries of the adjusting chambers 30.

The apparatus 1 further comprises two vanes 57. The vanes 57 are attached to the hub 50 and extend radially outward from the hub 50. The vanes 57 are accommodated in an adjusting chamber 30 each and separate the associated adjusting chambers 30 into a first sub-chamber 31 and a second sub-chamber 32, respectively. The first sub-chambers 31 and the second sub-chambers 32 alternate in a circumferential direction.

Each vane 57 is in touch both with the axial boundaries of the associated adjusting chamber 30 and with one of the radially outer boundary and the radially inner boundary of the associated adjusting chamber 30, to thereby seal the sub-chambers 31, 32 from each other. Thus, each vane 57 limits a free (i.e. uncontrolled) flow of a hydraulic fluid between the first sub-chambers 31 and the second sub-chambers 32 of the associated adjusting chamber 30. Accordingly, by pumping a fluid from the first sub-chamber 31 into the second sub-chamber 32, each vane 57 can be swivelled relative to the associated adjusting chamber 30.

Both adjusting chambers 30 and vanes 57 are disposed on opposite sides of the common rotational axis 2, respectively. The depicted number of vanes 57 and corresponding adjusting chambers 30 is a preferred number, but only an example. Other numbers of vanes 57 and adjusting chambers 30 may be realized as well.

Figure 5A:
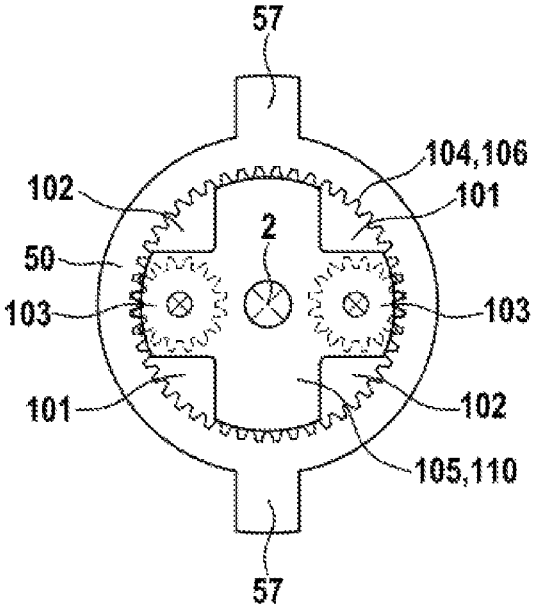
FIG. 5*a* shows a schematic axial front view of the partially assembled camshaft timing apparatus according to the embodiment shown in FIG. 1.
Figure 5B:
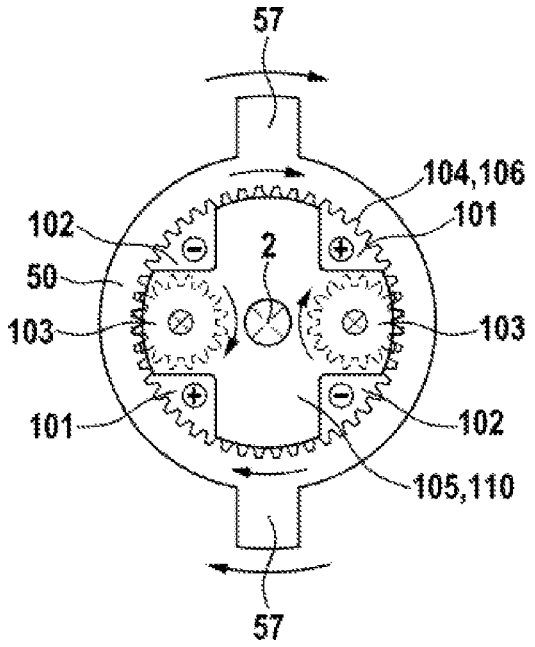
FIG. 5*b* shows the view of FIG. 5*a* with indications of rotational directions and pressure situation during operation.

The apparatus 1 further comprises a hydraulic pump 100, which is an internal gear pump shown best in FIGS. 4 and 5*a*, 5*b*. The hydraulic pump 100 is accommodated in the hub 50, i.e. arranged in a central cylindrical through-hole 51 defined by the hub 50. The hydraulic pump 100 has two high pressure pump chambers 101 and two low pressure pump chambers 102. The high pressure pump chambers 101 and the low pressure pump chambers 102 alternate in a circumferential direction. Each pump chamber 101, 102 is fluidly connected to each first sub-chamber 31 and each second sub-chamber 32.

Figure 6:
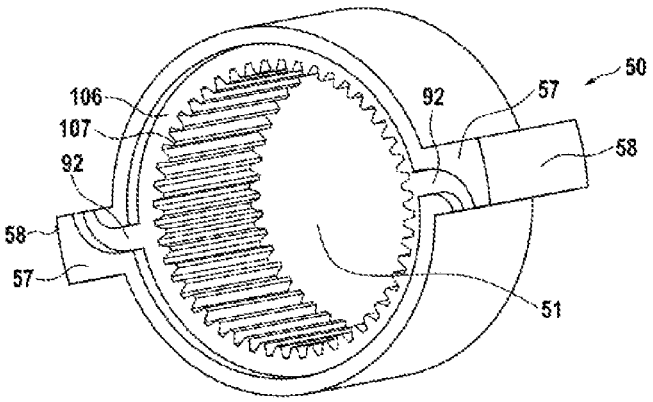
FIG. 6 shows a perspective view of the hub of the camshaft timing apparatus according to the embodiment shown in FIG. 1.

The hydraulic pump 100 comprises a stator 104, a rotor 105 and two pump 103 for pumping a hydraulic fluid from the low pressure pump chamber 102 to the high pressure pump chamber 101. The stator 104 comprises an internal gear 106 which is integral with and, thus, torque-proof connected to the hub 50, see FIG. 6. The rotor 105 comprises a rotor body 110 being disposed within the internal gear 106. The rotor body 110 is supported rotationally about the common rotational axis 2 e.g. such that teeth 107 of the internal gear 106 and peripheral surface sections 111 of the rotor body 110 abut to form a radial bearing. The tips of the teeth 107 are configured to provide small peripheral surface sections which are complementary to the peripheral surface sections 111 of the rotor body 110.

Figure 7:
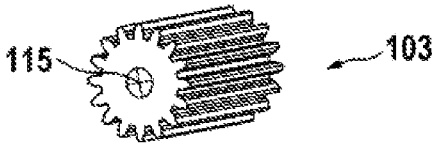
FIG. 7 shows a perspective view of a gear wheel of the camshaft timing apparatus according to the embodiment shown in FIG. 1.

The pump 103 are configured for pumping the hydraulic fluid from the low pressure pump chamber 102 to the high pressure pump chamber 101 due to a rotation of the rotor 105 relative to the stator 104. The pump 103 are gear wheels (see FIG. 7) being supported by the rotor body 110. The pump 103 are engaged with the internal gear 106 and have rotational axes 115 essentially parallel to the common rotational axis 2. The pump 103 have a circular cylindrical envelope. This means that the tips of the teeth of the gear wheel define a circular cylindrical surface being centered on the rotational axis of the gear wheels.

When the rotor body 110 rotates relative to the internal gear 106, the pump 103 rotate relative to the rotor body 110 due to their engaging teeth. Thereby, the pump 103 and the rotor body 110 are counter-rotating, i.e. the pump 103 rotate in the counterclockwise direction when the rotor body 110 rotates in the clockwise direction or vice versa.

Figure 8:
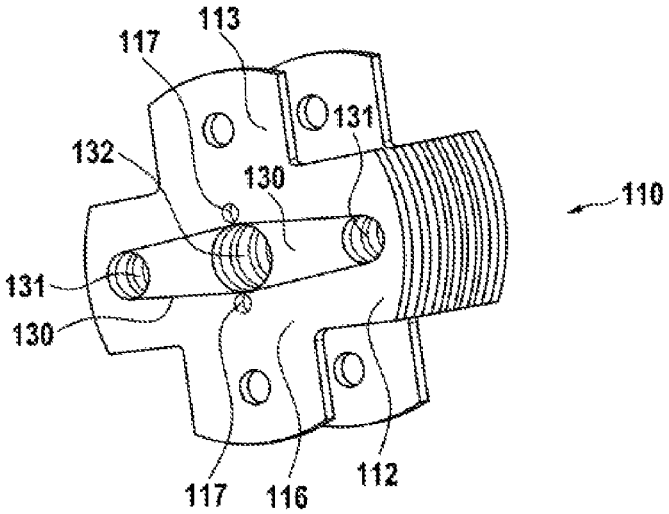
FIG. 8 shows a perspective view of the rotor body of the camshaft timing apparatus according to the embodiment shown in FIG. 1.
Figure 9:
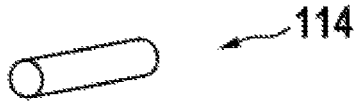
FIG. 9 shows a perspective view of a bearing pin of the camshaft timing apparatus according to the embodiment shown in FIG. 1.

As can be best seen from FIG. 8, the rotor body 110 may comprise e.g. two separating arms 112 and e.g. two pumping arms 113 extending in a radial direction. The arms 112, 113 alternate in a circumferential direction and separate from each other the high pressure pump chambers 101 and the low pressure pump chambers 102. The two pumping arms 113 each support a bearing pin 114 shown in FIG. 9. The bearing pin rotationally supports a pump 103 and defining a fluid passage between a high pressure pump chamber 101 and an adjacent low pressure pump chamber 102. The pump 103 have at least essentially parallel rotational axes 115. As well the rotational axes 115 of the pump 103 are evenly spaced to the common rotational axis 2.

Figure 10:
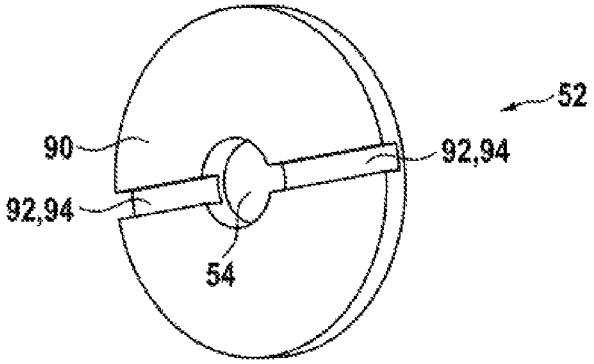
FIG. 10 shows a perspective view of a first hub lid of the camshaft timing apparatus according to the embodiment shown in FIG. 1.
Figure 11:
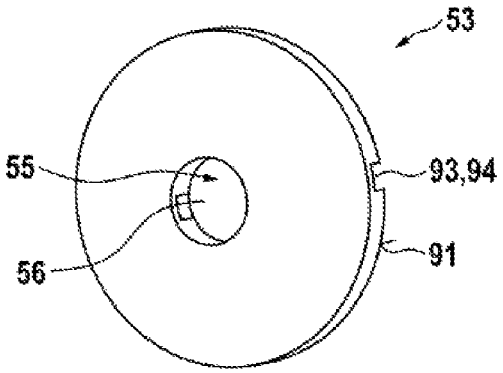
FIG. 11 shows a perspective view of second hub lid of the camshaft timing apparatus according to the embodiment shown in FIG. 1.

The hub 50 comprises a first hub lid 52 and a second hub lid 53. The first and second hub lids 52, 53 are shown in FIGS. 10 and 11, respectively. The first and second hub lids 52, 53 are axially and rotationally secured to the hub 50 and axially close the through-hole 51 on opposite sides of the hub 50. The first and second hub lids 52, 53 have multiple functions. On the one hand, they provide inner surface sections for forming an axial bearing with complementary surface sections of the hydraulic pump 100. On the other hand, they axially close the high pressure pump chambers 101 and the low pressure pump chambers 102 of the hydraulic pump 100. Apart from that, the second hub lid allows for the camshaft of the combustion engine to be coupled to the hub 50. The second hub lid 53 comprises a coupler 56 configured to provide a torque-proof connection with the camshaft wherein the coupler 56 and/or the camshaft extends through a central camshaft through-hole 12 defined in the base disc 11 of the drive disc 10.

The hub 50 comprises two first adjusting channels 92. The two first adjusting channels 92 are configured as grooves in a first axial surface 90 of the hub 50 each extending radially outward from a central through-hole 54 of the first hub lid to a vane 50 and each bending into a first peripheral direction to open into a first sub-chamber 31. The hub 50 further comprises two second adjusting channels 93. The two second adjusting channels 93 are configured as grooves in a second axial surface 91 of the hub 50 each extending radially outward from a central through-hole 55 of the second hub lid 53 to a vane 50 and each bending into a second peripheral direction to open into a second sub-chamber 32 wherein the first and second adjusting channels 92, 93 have straight sections 94 formed in the first and second hub lids 52, 53, respectively. In other words, the first and second sub-chambers 31, 32 of the apparatus 1 are fluidly connected to the hydraulic pump 100 via the central through-hole 54, 55 in the first and second hub lids 52, 53 and via the first and second adjusting channels 92, 93 configured in the first and second hub lids 52, 53 as well as in the axial surfaces 90, 91 of the vanes 50, respectively.

Figure 12:
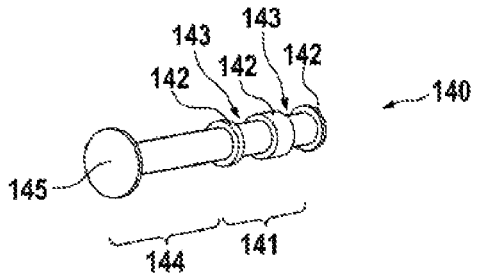
FIG. 12 shows a perspective view of the valve actuator of the camshaft timing apparatus according to the embodiment shown in FIG. 1.
Figure 13:
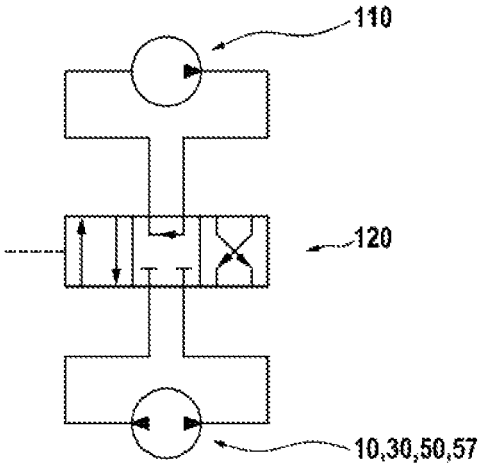
FIG. 13 shows a circuit diagram of the valve assembly of the camshaft timing apparatus according to the embodiment shown in FIG. 1.

The apparatus 1 further comprises a valve assembly 120. The valve assembly 120 is arranged within the hub 50 and comprises a valve actuator 140 which is shown in FIG. 12. The valve assembly works as a three-state switching valve which is schematically shown in FIG. 13 connected to a hydraulic pump and a hydraulic motor.

Figure 14:
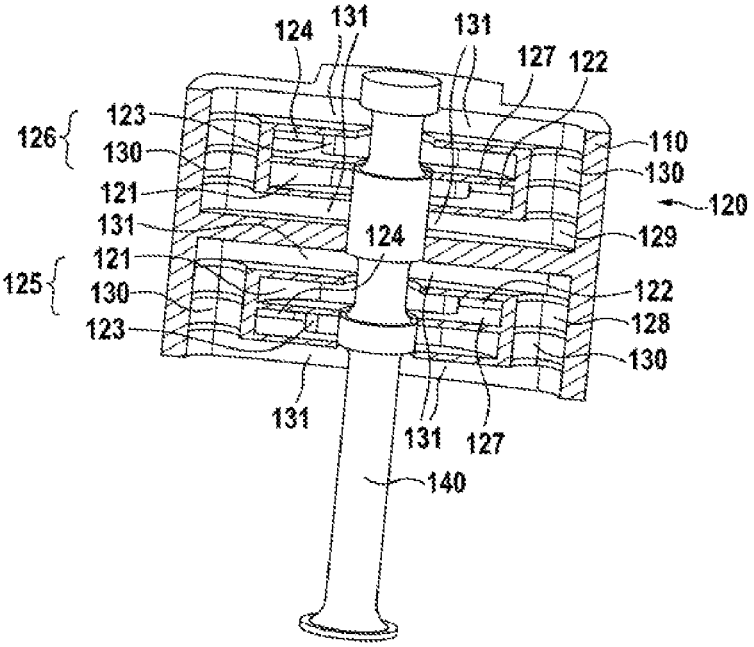
FIG. 14 shows a perspective cross-sectional view of the rotor body shown in FIG. 8 with the valve actuator shown in FIG. 12 in a first position.

The valve assembly 120 has a first state fluidly connecting the high pressure pump chamber 101 to the first sub-chamber 31 as well as the low pressure pump chamber 102 to the second sub-chamber 32, respectively. In the first state, the valve actuator 140 is in a first axial position, which may be referred to as a forward position, providing a fluid communication between the high pressure pump chamber 101 and the first sub-chamber 31 as well as between the low pressure pump chamber 102 and the second sub-chamber 32, see FIG. 14.

Figure 15:
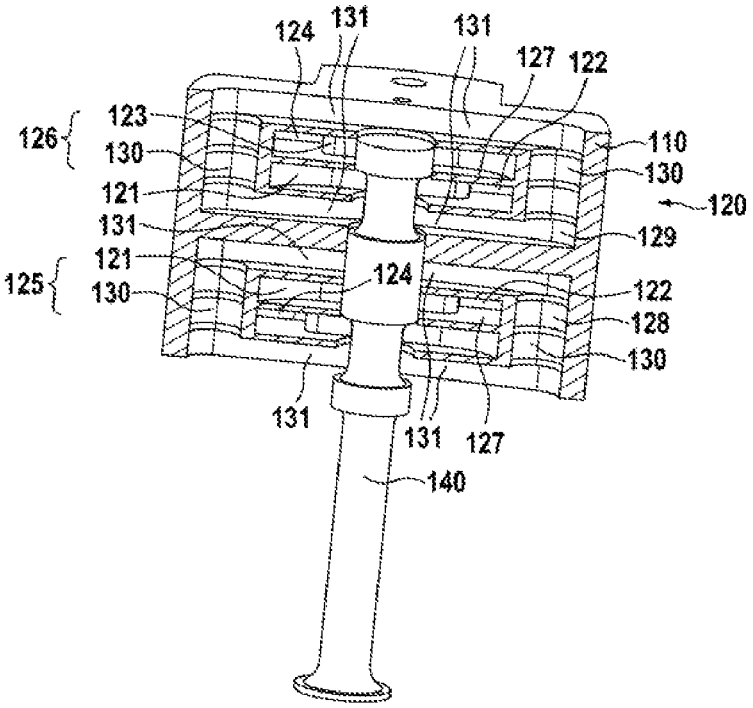
FIG. 15 shows a perspective cross-sectional view of the rotor body shown in FIG. 8 with the valve actuator shown in FIG. 12 in a second position.

The valve assembly 120 has a second state fluidly connecting the high pressure pump chamber 101 to the second sub-chamber 32 as well as the low pressure pump chamber 102 to the first sub-chamber 31, respectively. In the second state, the valve actuator 140 is in a second axial position, which may be referred to as a backward position, providing a fluid communication between the high pressure pump chamber 101 and the second sub-chamber 32 as well as between the low pressure pump chamber 102 and the first sub-chamber 31, see FIG. 15.

Figure 16:
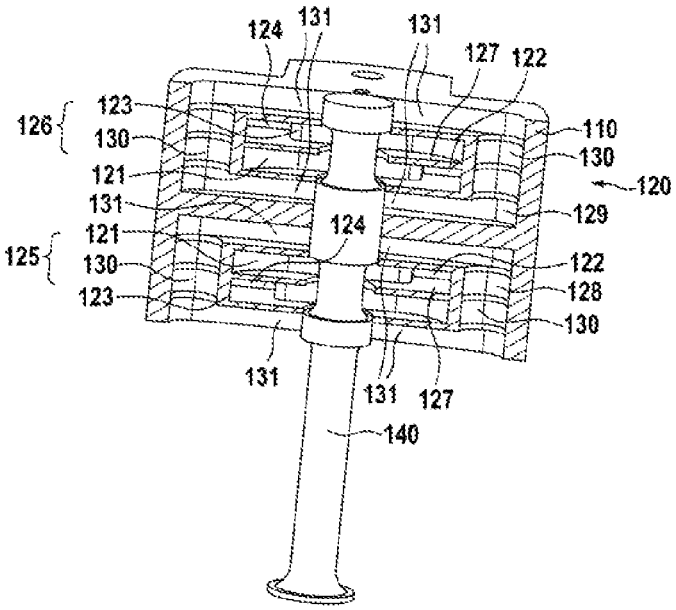
FIG. 16 shows a perspective cross-sectional view of the rotor body shown in FIG. 8 with the valve actuator shown in FIG. 12 in a third position.

The valve assembly 120 has a third state fluidly connecting the high pressure pump chamber 101 to the low pressure pump chamber 102 and fluidly separating the first sub-chamber 31 from the second sub-chamber 32. In the third state, the valve actuator 140 is in a third axial position, which may be referred to as a neutral position, providing a short circuit fluid connection between the high pressure pump chambers 101 and the low pressure pump chambers 102 and separating the first sub-chambers 31 from the second sub-chambers 32, see FIG. 16.

By selecting one of the first, second and third positions of the valve actuator 140, the hydraulic fluid is either pumped from the second sub-chamber 32 to the first sub-chamber 31 to swivel the hub 50 relative to the drive disc 10 in a forward direction or pumped from the first sub-chamber 31 to the second sub-chamber to 32 swivel the hub 50 relative to the drive disc 10 in a backward direction or not pumped between the first and second sub-chambers 31, 32 to not swivel the hub 50 relative to the drive disc 10.

The rotor body 110 comprises two first internal valve chambers 121 each being fluidly connected to each high pressure pump chamber 101 by a high pressure channel 122. The rotor body 110 further comprises two second internal valve chambers 123 each being fluidly connected to each low pressure pump chambers 102 by a low pressure channel 124 wherein the first and second internal valve chambers 121, 123 are juxtaposed in an axial direction. The pressure of the hydraulic fluid in the internal valve chambers 121, 123, thus, is identical to the connected high pressure pump chambers 101 or low pressure pump chambers 102, respectively. Each of the high pressure channels 122 and low pressure channels 124 is configured as a through-hole extending from the respective internal first or second valve chamber 121, 123 to the respective high or low pressure pump chamber 101, 102.

The internal valve chambers 121, 123 are arranged in a first pair 125 and a second pair 126 each comprising a first internal valve chamber 121 and a second internal valve chamber 123. The first and second valve chambers 121, 123 of a pair 125, 126 are separated by a separation wall 127, wherein the first and second pairs 125, 126 are juxtaposed in an axial direction and wherein the axial sequence of the first and second internal valve chambers 121, 123 is different between the pairs 125, 126. This pairwise configuration of the first and second internal valve chambers 121, 123 corresponds to the configuration of the first and second adjusting channels 92, 93 of the hub 50.

The rotor body 110 comprises a first annular channel 128 and a second annular channel 129 each surrounding the corresponding first or second pair of internal valve chambers 121, 123. Each annular channel 128, 129 has two axial channel sections 130 being disposed spaced apart in the separating arms 112, and two radial channel sections 131. The radial channel sections 131 connect corresponding axial ends of the axial channel sections 130 wherein each outer axial channel section 130 is configured as a groove extending in the corresponding axial surface 116 of the rotor body 110. The first and second annular channels 128, 129 are, via the central through-holes 54, 55 of the first and second hub lids 52, 53, in a permanent fluid connection with the first and second adjusting channels 92, 93 and, indirectly, with the first and second sub-chambers 31, 32, respectively.

The rotor body 110 has a central cylindrical actuating through-hole 132 extending axially through the rotor body 110 and being fluidly connected with the first internal valve chambers 121, the second internal valve chambers 123 and the radial channel sections 131 of the first and second annular channels 128, 129. In other words, the rotor body 110 has a double function. On the one hand, the rotor body 110 allows for pumping the hydraulic fluid from the low pressure pump chamber 102 to the high pressure pump chamber 101 of the hydraulic pump 100. On the other hand, the rotor body 110 is part of the valve assembly 120 providing fluid connections to the high pressure pump chambers 101 and to the low pressure pump chambers 102 of the hydraulic pump 100 and to the first and second sub-chambers 31, 32 in the form of the first and second pairs 125, 126 and the first and second annular channels 128, 129, respectively.

The valve actuator 140 comprises a pin-like valve needle having an operating section 144 and an actuating section 141 wherein the actuating section 141 is arranged central and axially displaceable in the actuating through-hole 132 of the rotor body 110 and wherein the operating section 144 extends through the central through-hole 54 of the first hub lid 52 and a central torque transmitting through-hole 23 of the casing lid 22 and has a head 145 at its outer free end. The valve actuator 140 may be axially coupled to a valve control unit via the head 145. Thereby, the head 145 provides axial and radial bearing surface sections for allowing the valve actuator 140 to rotate at a different angular speed than an interface of the valve control unit providing complementary surface sections. The actuating section 141 is configured to open and close the first and second internal valve chambers 121, 123 as well as the angular channels 128, 129 at different axial positions of the valve actuator 140.

The actuating section 141 comprises a plurality of annular protrusions 142 being juxtaposed in an axial direction and defining axial clearances 143 in between. The annular protrusions 142 are arranged and configured to selectively and exclusively open fluid connections between the first and second internal valve chambers 121, 123 and the first and second annular channels 128, 129. In the first axial position of the valve actuator 140 fluid connections between the first internal valve chambers 121 and the first annular channel 128 as well as the second internal valve chambers 123 and the second annular channel 129 are opened, respectively. In a second position of the valve actuator 140 fluid connections between the first internal valve chambers 121 and the second annular channel 129 as well as the second internal valve chambers 123 and the first annular channel 128 are opened, respectively. In a third axial position of the valve actuator 140 fluid connections between the first internal valve chambers 121 and the second internal valve chambers 123 are opened while the first and second annular channels 128, 129 are closed.

The axial length and the radial width of the annular protrusions 142 as well as the axial length of the clearances 143 correspond to the axial configuration of the first and second pairs 125, 126 with the first and second internal valve chambers 121, 123 therein, of the first and second annular channels 128, 129 and the axial distances between these elements.

Figure 17:
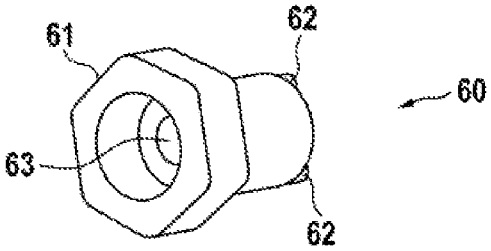
FIG. 17 shows a perspective view of the torque transmission of the camshaft timing apparatus according to the embodiment shown in FIG. 1.

The apparatus 1 further comprises a torque transmission 60 which is shown in FIG. 17. The torque transmission 60 is configured as a cylindrical bolt being torque-proof connected to the rotor 105 for establishing a relative rotation between the rotor 105 and the stator 104. Thus, by securing the torque transmission 60 to a static part, i.e. a non-rotating part of the combustion engine, the hydraulic pump 100 is exclusively and immediately driven by a rotation of the hub 50 or the drive disc 10 relative to the torque transmission 60.

The torque transmission 60 extends through the torque transmission through-hole 23 of the casing lid 22 and the central through-hole 54 of the first hub lid 52. The torque transmission 60 has a coupler 62. The coupler 62 is configured as a hexagonal head and disposed at an outer end. The torque transmission 60 has a connector 61 disposed at an opposite inner end. The connector 61 are configured to establish the torque-proof connection between the torque transmission 60 and the rotor body 110.

The torque transmission 60 defines a central cylindrical operating through-hole 63. The operating through-hole 63 extends axially and has a diameter which, at the same time, rotationally supports the operating section 144 of the valve actuator 140 and seals the casing 20 of the drive disc 10 against loss of the hydraulic fluid. The operating through-hole 63 is penetrated by the operating section 144 of the valve actuator 140.

The connector 61 is configured as two pin-like protrusions being disposed eccentrically and extending axially from the inner free end of the torque transmission 60. The pin-like protrusions are disposed on opposite sides of the operating through-hole 63. The pin-like protrusions engage with complementary recesses 117 formed in an axial surface of the rotor body 110 and are thus an example of a torque-transmitting coupling between the torque transmission 60 and the rotor body 110.

After assembly, the apparatus 1 is preferably completely filled with a hydraulic fluid. The drive disc 10 is may be connected to the crankshaft of the combustion engine. The hub 50 may be coupled to the camshaft of the combustion engine. The torque transmission 60 may be coupled to a static part of the combustion engine. The valve actuator 140 may be coupled with a valve control unit.

During operation, the crankshaft rotationally drives the drive disc 10 together with the enclosed hub 50. Assuming no fluid flow between the sub-chambers 31, 32 the drive disc 10 drives the hub 50 and thus the camshaft. The rotation of the internal gear 106 which rotates with the hub 50 relative to the rotor body 110 (which does not rotate due to the torque transmission 60) drives the hydraulic pump 100. The hydraulic pump 100 generates a pressure gradient between its pump chambers 101, 102 which, consequently, act as high pressure pump chambers 101 and low pressure chambers 102. The valve control unit may control the valve assembly 120 by axially displacing the valve actuator 140 on demand into one of three axial positions. Depending on the axial position of the valve actuator 140 the hydraulic fluid is pumped or not pumped between the first and second sub-chambers 31, 32. Correspondingly, the hub 50 is swivelled forth or back or not swivelled relative to the disc drive 10 in order to adjust or maintain a required angular relation between the drive disc 10 and the hub 50 or the crankshaft and the camshaft of the combustion engine, respectively.

The apparatus 1, hence, is very compact due to integrating the valve assembly 120 into the hydraulic pump 100 and, at the same time, integrating the hydraulic pump 100 into the hub 50. Apart from that, the hydraulic pump 100 can immediately be driven by the camshaft without imposing any immediate load on the crankshaft.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. An apparatus for camshaft timing adjustment, the apparatus comprising:

a drive disc and a hub rotationally supported relative to each other and defining a common rotational axis, the hub being arranged within the drive disc;

a first vane;

a second vane;

a first adjusting chamber;

a second adjusting chamber, wherein the first vane is accommodated in the first adjusting chamber defined by the drive disc and/or the hub and separates the first adjusting chamber into a first sub-chamber and a second sub-chamber, the first vane being attached to the hub or the drive disc and the second vane is accommodated in the second adjusting chamber and separates the second adjusting chamber into a first sub-chamber and a second sub-chamber, the second vane being attached to the hub or the drive disc;

a hydraulic pump having a high pressure pump chamber, a low pressure pump chamber and a pump for pumping a hydraulic fluid from the low pressure pump chamber to the high pressure pump chamber, each pump chamber being fluidly connected to the first sub-chamber and the second sub-chamber; and a valve assembly comprising a valve actuator, the valve assembly comprising:

a first state for enabling a flow of the hydraulic fluid from the second sub-chamber to the first sub-chamber; and a second state for enabling a flow of the hydraulic fluid from the first sub-chamber to the second sub-chamber, wherein the valve assembly is arranged within the hydraulic pump and the hydraulic pump is arranged within the hub.

2. The apparatus according to claim 1, wherein the drive disc has a casing accommodating the hub, the casing comprising a casing wall and a casing lid axially closing the casing.

3. The apparatus according to claim 2, wherein the drive disc comprises a plurality of separators configured as protrusions extending radially inward from the casing wall and separating the first adjusting chamber from the second adjusting chamber in a circumferential direction.

4. The apparatus according to claim 3, wherein exactly two vanes, consisting of the first vane and the second vane, and two adjusting chambers, consisting of the first adjusting chamber and the second chamber, are disposed on opposite sides of the common rotational axis.

5. The apparatus according to claim 3, wherein the first sub-chambers and the second sub-chambers alternate in a circumferential direction.

6. The apparatus according to claim 1, wherein the hub defines a central through-hole accommodating the hydraulic pump.

7. A method for manufacturing the apparatus according to claim 1, the method comprising:

arranging the hydraulic pump within the hub; and arranging the valve assembly within the hydraulic pump.

8. An apparatus for camshaft timing adjustment, the apparatus comprising:

a drive disc and a hub rotationally supported relative to each other and defining a common rotational axis, the hub being arranged within the drive disc;

a vane accommodated in an adjusting chamber defined by the drive disc and/or the hub and separating the adjusting chamber into a first sub-chamber and a second sub-chamber, the vane being attached to the hub or the drive disc;

a hydraulic pump having a high pressure pump chamber, a low pressure pump chamber and a pump for pumping a hydraulic fluid from the low pressure pump chamber to the high pressure pump chamber, each pump chamber being fluidly connected to the first sub-chamber and the second sub-chamber; and a valve assembly comprising a valve actuator, the valve assembly comprising:

a first state for enabling a flow of the hydraulic fluid from the second sub-chamber to the first sub-chamber; and a second state for enabling a flow of the hydraulic fluid from the first sub-chamber to the second sub-chamber, wherein the valve assembly is arranged within the hydraulic pump and the hydraulic pump is arranged within the hub, wherein the hub defines a central through-hole accommodating the hydraulic pump, and wherein the hub comprises a first hub lid and a second hub lid axially closing the through-hole on opposite sides of the hub, the second hub lid comprising a coupler configured to provide a torque-proof connection with a camshaft wherein the coupler and/or the camshaft extends through a central camshaft through-hole of the drive disc.

9. The apparatus according to claim 8, wherein the hub comprises two first adjusting channels being configured as grooves in a first axial surface of the hub, each first adjusting channel extending radially outward from a central through-hole of the first hub lid to the vane and each first adjusting channel bending into a first peripheral direction to open into the first sub-chamber, and two second adjusting channels being configured as grooves in a second axial surface of the hub each second adjusting channel extending radially outward from a central through-hole of the second hub lid to a second vane and each second adjusting channel bending into a second peripheral direction to open into the second sub-chamber, and wherein the first and second adjusting channels have straight sections formed in the first and second hub lids, respectively.

10. An apparatus for camshaft timing adjustment, the apparatus comprising:

a drive disc and a hub rotationally supported relative to each other and defining a common rotational axis, the hub being arranged within the drive disc;

a vane accommodated in an adjusting chamber defined by the drive disc and/or the hub and separating the adjusting chamber into a first sub-chamber and a second sub-chamber, the vane being attached to the hub or the drive disc;

a hydraulic pump having a high pressure pump chamber, a low pressure pump chamber and a pump for pumping a hydraulic fluid from the low pressure pump chamber to the high pressure pump chamber, each pump chamber being fluidly connected to the first sub-chamber and the second sub-chamber; and a valve assembly comprising a valve actuator, the valve assembly comprising:

a first state for enabling a flow of the hydraulic fluid from the second sub-chamber to the first sub-chamber; and a second state for enabling a flow of the hydraulic fluid from the first sub-chamber to the second sub-chamber, wherein the valve assembly is arranged within the hydraulic pump and the hydraulic pump is arranged within the hub, and wherein the hydraulic pump has a stator and a rotor, the pump being supported by the stator or the rotor and configured for pumping the hydraulic fluid from the low pressure pump chamber to the high pressure pump chamber due to a rotation of the rotor relative to the stator.

11. The apparatus according to claim 10, wherein the stator is integral with and/or torque-proof connected to the hub, and/or the pump is supported by the rotor.

12. The apparatus according to claim 11, wherein the stator comprises an internal gear being attached to the hub and the rotor comprising a rotor body being disposed within the internal gear and supported rotationally about the common rotational axis such that teeth of the internal gear and peripheral surface sections of the rotor body abut to form a radial bearing.

13. The apparatus according to claim 12, wherein the pump is a gear wheel being supported by the rotor body and/or engaged with the internal gear and having a rotational axis parallel to the common rotational axis.

14. The apparatus according to claim 12, wherein the rotor body comprises two separating arms and two pumping arms extending in a radial direction and alternating in a circumferential direction and separating the high pressure pump chamber into two sub-compartments and the low pressure pump chamber into two sub-compartments alternating in a circumferential direction, the two pumping arms each supporting a bearing pin rotationally supporting the pump and defining a fluid passage between one of the high pressure pump chambers and an adjacent one of the low pressure pump chambers.

15. The apparatus according to claim 14, wherein the rotor body comprises two first internal valve chambers each being fluidly connected to each high pressure pump chamber by a respective high pressure channel and two second internal valve chambers each being fluidly connected to each low pressure pump chambers by a respective low pressure channel, and wherein the first and second internal valve chambers are juxtaposed in an axial direction.

16. The apparatus according to claim 15, wherein the two internal valve chambers and the two second internal valve chambers are each arranged in a first pair and a second pair, the first pair and the second pair each comprising a first internal valve chamber and a second internal valve chamber being separated by a separation wall, wherein the first and second pairs are juxtaposed in an axial direction, and wherein the axial sequence of the first and second internal valve chambers is different between the pairs.

17. The apparatus according to claim 16, wherein the rotor body comprises a first annular channel and a second annular channel each surrounding the corresponding pair of internal valve chambers and having two axial channel sections being disposed spaced apart in the separating arms, and two radial channel sections connecting corresponding axial ends of the axial channel sections, wherein each outer axial channel section is configured as a groove extending in the corresponding axial surface of the rotor body.

18. The apparatus according to claim 17, wherein the rotor body has a central actuating through-hole extending axially through the rotor body and being fluidly connected with the first internal valve chambers, the second internal valve chambers and the radial channel sections of the first and second annular channels.

19. The apparatus according to claim 18, wherein the valve actuator comprises a pin-like valve needle having an operating section and an actuating section, and wherein the actuating section is arranged central and axially displaceable in the actuating through-hole of the rotor body.

20. The apparatus according to claim 19, wherein the actuating section comprises a plurality of annular protrusions being juxtaposed in an axial direction and defining axial clearances in between, the annular protrusions being arranged and configured to selectively and exclusively open in a first axial position of the valve actuator fluid connections and in a second axial position of the valve actuator fluid connections.

21. The apparatus according to claim 20, wherein the valve assembly has a third state fluidly connecting the high pressure pump chamber to the low pressure pump chamber and fluidly separating the first sub-chamber from the second sub-chamber, wherein the valve actuator in a third axial position opens a connection between the first internal valve chambers and the second internal valve chambers while closing the first and second annular channels.

22. The apparatus according to claim 10, wherein the apparatus comprises a torque transmission being torque-proof connected to the rotor for establishing a relative rotation between the rotor and the stator.

23. An apparatus for camshaft timing adjustment, the apparatus comprising:

a drive disc and a hub rotationally supported relative to each other and defining a common rotational axis, the hub being arranged within the drive disc;

a vane accommodated in an adjusting chamber defined by the drive disc and/or the hub and separating the adjusting chamber into a first sub-chamber and a second sub-chamber, the vane being attached to the hub or the drive disc;

a hydraulic pump having a high pressure pump chamber, a low pressure pump chamber and a pump for pumping a hydraulic fluid from the low pressure pump chamber to the high pressure pump chamber, each pump chamber being fluidly connected to the first sub-chamber and the second sub-chamber; and a valve assembly comprising a valve actuator, the valve assembly comprising:

a first state for enabling a flow of the hydraulic fluid from the second sub-chamber to the first sub-chamber; and a second state for enabling a flow of the hydraulic fluid from the first sub-chamber to the second sub-chamber, wherein the valve assembly is arranged within the hydraulic pump and the hydraulic pump is arranged within the hub, wherein the hub defines a central through-hole accommodating the hydraulic pump, wherein the apparatus comprises a torque transmission being torque-proof connected to the rotor for establishing a relative rotation between the rotor and the stator, wherein the torque transmission extends through a central torque transmitting through-hole of a casing lid and a central through-hole of a first hub lid, and wherein the torque transmission has a coupler disposed at an outer end and a connector disposed at an opposite inner end, the connector being configured to establish the torque-proof connection between the torque transmission and a rotor body.

24. The apparatus according to claim 23, wherein the torque transmission defines a central operating through-hole extending axially which is penetrated by an operating section of the valve actuator.

25. The apparatus according to claim 24, wherein the connector is configured as a pin-like protrusion being disposed eccentrically and extending axially from the inner free end, and wherein the rotor body comprises a complementary recess formed in an axial surface and being engaged by the connector.

26. The apparatus according to claim 25, wherein the connector is configured as a plurality of protrusions being disposed around the operating through-hole, particularly two protrusions disposed on opposite sides of the operating through-hole, and that the rotor body comprises corresponding recesses.

27. The apparatus according to claim 23, wherein the coupler is configured as a hexagonal head.

* * * * *